US005547238A

United States Patent [19]

Payette

[11] Patent Number: 5,547,238

[45] Date of Patent: Aug. 20, 1996

[54] CIRCULAR DISK DOORSTOP

[76] Inventor: Richard Payette, P.O. Box 214, Newcastle, N.H. 03854

[21] Appl. No.: 238,538

[22] Filed: May 5, 1994

[51] Int. Cl.[6] ..... E05F 5/00

[52] U.S. Cl. ..... 292/343; 16/86 R; D8/402

[58] Field of Search ..... 16/86 A, 86 R, 16/82; 292/343, DIG. 15; D8/402

[56] References Cited

U.S. PATENT DOCUMENTS

| | | | |
|---|---|---|---|
| D. 173,487 | 11/1954 | Hines | D8/402 |
| 1,958,807 | 5/1934 | Thompson | 292/343 |
| 3,143,369 | 8/1964 | Adams | 292/343 |
| 3,328,065 | 6/1967 | Arenson | 292/343 |

FOREIGN PATENT DOCUMENTS

| | | | |
|---|---|---|---|
| 619753 | 10/1980 | Switzerland | 292/343 |
| 416610 | 9/1934 | United Kingdom | 292/343 |

*Primary Examiner*—M. Rachuba
*Assistant Examiner*—Donald M. Gurley
*Attorney, Agent, or Firm*—Frederick R. Cantor, Esq.

[57] ABSTRACT

A portable doorstop is formed to a circular disk configuration so that the doorstop disk enjoys a stable positionment on the floor surface. The disk upper surface includes a conical surface portion centered on the disk central axis for wedge fit interaction with the lower edge of a door. The disk can be placed in any desired position in the path of the door because the conical surface achieves a wedge fit with the door no matter which area of the conical surface comes into contact with the door lower edge.

2 Claims, 2 Drawing Sheets

CIRCULAR DISK DOORSTOP

BACKGROUND OF THE PRESENT INVENTION

1. Field of the Invention

The present invention relates to doorstops. The present invention more particularly relates to portable doorstops that can be placed on the floor in the path of a door when it is swung to its open position, whereby the doorstop grips the lower edge of the door to prevent the door from rebounding toward the door opening.

2. Prior Developments

Portable doorstops are sometimes used where it is not desired to permanently affix the doorstop to the floor or wall in the path of a swinging door. One known portable doorstop comprises a wedge-shaped block of resilient material having a first flat surface seatable on the floor and a second flat surface adapted to have a slight inclination in the path of a door during movement of the door to its open position.

As the lower edge of the door contacts the inclined surface of the resilient doorstop, the doorstop material is slightly compressed between the floor and the door lower edge, whereby the doorstop becomes wedged between the door lower edge and the floor. The compressed doorstop material exerts a frictional force on the lower edge of the door so that the door is prevented from rebounding toward its closed position. The doorstop keeps the door in its open position until the door is manually returned to the closed position.

One problem with the conventional wedge-shaped portable doorstop is that the doorstop is easily overturned to a condition where the doorstop is lying on its side, with the wedge surfaces extending vertically. An overturned doorstop is inoperable as a doorstop.

Another problem with the conventional wedge-shaped portable doorstop is that the doorstop usually has a relatively small surface area in contact with the floor. Consequently, when the lower edge of the door strikes the upper surface of the doorstop, the doorstop tends to slide bodily along the floor, rather than becoming wedged between the door lower edge and the floor. The problem is due to the fact that the doorstop has insufficient surface area in contact with the floor to achieve a satisfactory frictional grip on the floor. When the floor surface is a rug or carpet the doorstop can sometimes act as a ski to slide along the carpet surface.

A further problem with conventional wedge-shaped doorstops is that the doorstop has to be oriented so that its inclined wedge surface is in the plane of motion of the door. If the inclined wedge surface is in a plane oblique to the motion plane of the door, the doorstop may tend to be pushed aside by the door, rather than being wedged into the space between the door lower edge and the floor.

Another drawback of conventional wedge-shaped doorstops is that such doorstops tend to be ornamentally unattractive or unsightly in appearance. The doorstop has a block-like shape that does not harmonize with the room furniture styling or room appearance.

SUMMARY OF THE PRESENT INVENTION

An object of the present invention is to provide a doorstop. A further object of the present invention is to provide a portable doorstop having a circular disk shape. The upper surface of the circular disk has a conical configuration, wherein the slope of the cone surface is approximately fifteen degrees. When the disk is placed on a floor in the path of a door, the lower edge of the moving door will strike the cone surface, thereby causing the disk material to be wedged between the door lower edge and the floor. The disk material frictionally grips the door lower edge to releasably retain the door in its opened position.

One advantage of the circular disk construction is that the doorstop cannot be overturned. The circular disk lies flat on the floor so that it cannot be tipped over or otherwise become inoperative.

Another advantage of the circular disk doorstop construction is that the circular disk has a relatively large surface area in contact with the floor. It is very difficult to slide the disk along the floor; when the door lower edge strikes the cone surface of the disk, the disk immediately becomes wedged between the door lower edge and the floor, without sliding or slipping along the floor.

Another advantage of the circular disk doorstop construction is that the circular disk does not have to be specially oriented relative to the motion path of the door. The cone surface on the disk has conical surface sections facing in all directions (measured from the cone axis). Whatever the orientation of the circular disk on the floor, the disk cone surface will be in position to properly contact the door lower edge.

A further feature of the circular disk doorstop is that it is symmetrical around its central axis so as to be unobtrusive and ornamentally compatible with the room appearance. The circular disk blends in with the room decor, and does not detract from the room styling.

In summary, and in accordance with the above discussion, the foregoing objectives are achieved in the following embodiments:

1. A portable doorstop comprising a circular disk having a lower surface adapted to seat on a floor, and an upper surface adapted to engage the lower edge of a door;

said circular disk having a central vertical axis and a circular edge centered on said axis;

said disk upper surface comprising a convex conical surface centered on said central vertical axis;

said convex conical surface having a slope angle of approximately fifteen degrees for wedge fit interaction with a door lower edge; and said disk lower surface comprising an annular flat support surface proximate to the disk circular edge, and a concave surface centered on said central axis to form a cavity within the space circumscribed by said annular flat support surface.

2. The doorstop, as described in paragraph 1, wherein said circular disk is formed of a resilient deformable material.

3. The doorstop, as described in paragraph 1, wherein said circular disk has a diameter of approximately five inches, and a height of approximately three quarters inch measured along the disk central axis.

4. The doorstop, as described in paragraph 1, wherein said disk upper surface comprises an annular rim surface proximate to the disk circular edge; and said annular rim surface sloping upwardly from said circular edge at an angle of approximately thirty degrees to said flat horizontal support surface.

5. The doorstop, as described in paragraph 1, wherein said disk lower surface comprises an upstanding concave cylindrical surface joining said annular flat support surface to said concave surface.

6. The doorstop, as described in paragraph 5, wherein said concave surface is conical.

7. The doorstop, as described in paragraph 6, wherein said convex conical surface and said concave conical surface define an annular deflectable diaphragm.

8. The doorstop, as described in paragraph 1, wherein the thickness of the disk is such that the disk area circumscribed by the annular flat support surface forms an annular deflectable diaphragm.

9. The doorstop, as described in paragraph 1, wherein said concave surface is a conical surface spaced from said convex conical surface by a distance that measures about one-eighths inch, whereby said conical surfaces define an annular deflectable diaphragm.

10. The doorstop, as described in paragraph 1, wherein said convex conical surface has a multiplicity of concentric annular ridges extending therealong.

11. The doorstop, as described in paragraph 10, wherein the spacings between the ridges are less than the widths of the ridges.

12. The doorstop, as described in paragraph 1, wherein said convex conical surface is smooth, continuous and uninterrupted.

13. The doorstop, as described in paragraph 1, wherein said circular disk is formed of a resilient deformable material;

said circular disk having a diameter of about five inches, and a height of about three-quarter inch measured along the disk central axis;

the disk upper surface comprising an annular rim surface proximate to the disk circular edge, said annular rim surface sloping upwardly from said circular edge at an angle of approximately thirty degrees; and said concave surface comprising a concave cylindrical surface upstanding from said annular flat support surface, and a concave conical surface joined to said cylindrical surface.

14. The doorstop, as described in paragraph 13, wherein said convex conical surface has a multiplicity of concentric annular ridges extending therealong.

15. The doorstop, as described in paragraph 13, wherein said convex conical surface is smooth, continuous and uninterrupted.

A BRIEF DESCRIPTION OF THE DRAWINGS OF THE PRESENT INVENTION

DESCRIPTION OF THE PREFERRED EMBODIMENTS OF THE PRESENT INVENTION

Figure 1:
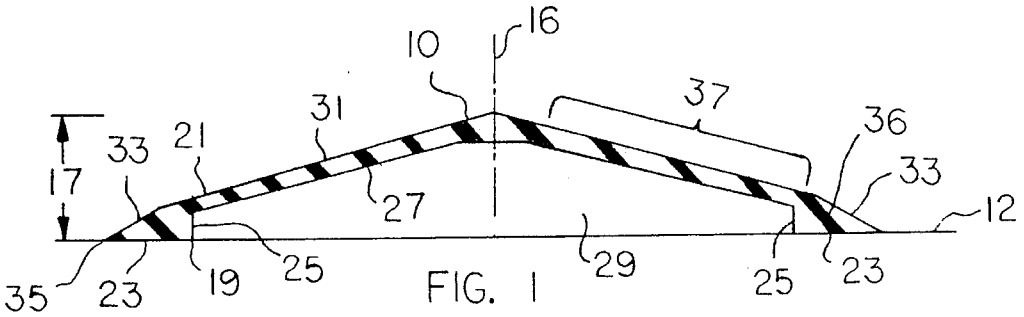
FIG. 1, is a sectional view, taken through a portable doorstop constructed according to the present invention.

FIG. 1, is a sectional view, taken through a portable door stop constructed according to the present invention.

Figure 2:
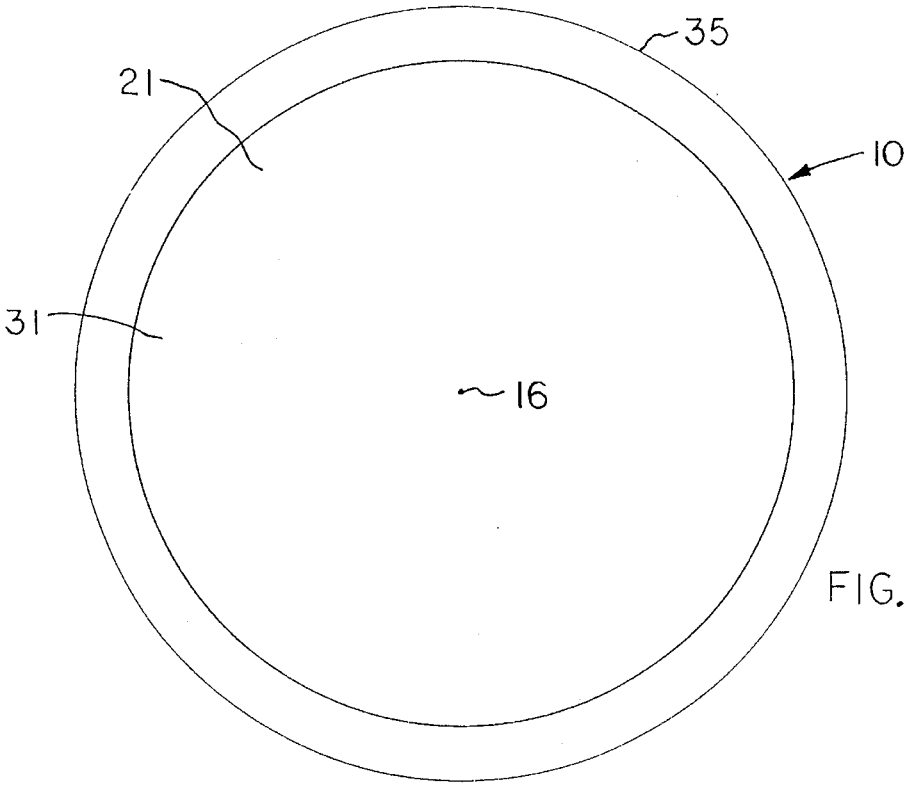
FIG. 2, is a top plan view, of the FIG. 1, doorstop.

FIG. 2, is a top plan view, of the FIG. 1 doorstop.

Figure 3:
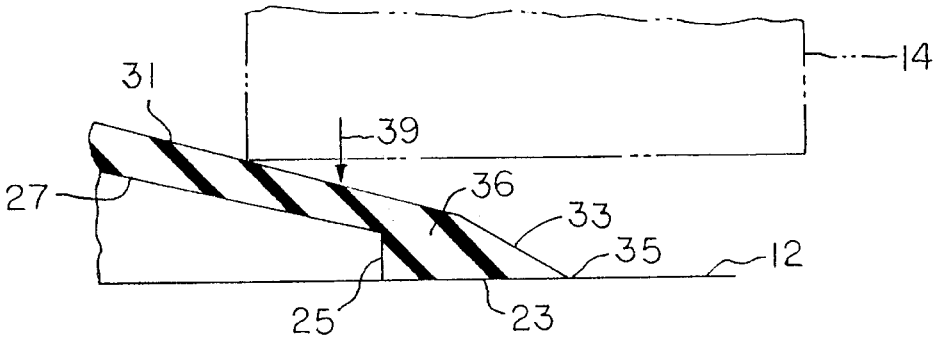
FIG. 3, is a fragmentary sectional view, taken in the same direction as FIG. 1, but to a larger scale.

FIG. 3, is a fragmentary sectional view, taken in the same direction as FIG. 1, but to a larger scale.

Referring to FIGS. 1 through 3, there is shown a portable doorstop of the present invention, comprising a circular disk 10, having a lower surface adapted to seat on a floor 12, and an upper surface adapted to engage the lower edge of a door 14 (FIG. 3), when the door is moved to its open position. The doorstop is portable so that it can be placed at any desired point on floor 12, in the path of the moving door.

The doorstop is usable on any floor e.g., linoleum, ceramic tile, hardwood floor or carpet. Typically, the circular disk doorstop will have a diameter of about five inches, and a height of about three-quarter inch measured along the central vertical axis 16, of the circular disk 10. In FIG. 1, the height of the circular doorstop is indicated by numeral 17.

The doorstop is placed on a floor 12, in the path of the door 14 toward its open position. The upper surface of the doorstop disk includes a conical surface having a slope (inclination) angle of about fifteen degrees, so that when the lower edge of the door contacts the conical surface the disk becomes wedged between the floor and the lower edge of the door. The wedge action causes the disk to grip the door lower edge to prevent the door from reverse swinging motion away from its open position. However, the door can be manually moved from its open position in the usual manner.

Circular disk 10, is preferably formed of a resilient deformable material, such as rubber; the durometer of the rubber is not critical to performance of the doorstop, although a reasonably stiff but still resilient disk material is preferred.

Disk 10, has a lower surface 19, and an upper surface 21. Lower surface 19, comprises a flat horizontal annular support surface 23, an upstanding cylindrical surface 25, at the inner edge of annular surface 23, and a concave conical surface 27, radiating inwardly from cylindrical surface 25.

Concave surfaces 25 and 27 cooperatively define a central cavity 29 on the underside of disk 10. Cavity 29 somewhat increases the flexibility of the disk, and also enhances the ability of annular surface 23 to effectively grip the floor 12. For example, when the disk is positioned on a carpet some of the carpet fibers will extend upwardly into central cavity 29, such that annular support surface 23, will be partially embedded or depressed into the carpet surface plane. The cylindrical surface 25, will capture and contact the tip areas of carpet fibers so that disk 10, remains in a stable position when forcibly engaged by the lower edge of door 14.

When circular disk 10 is positioned on a floor 12 having a hard surface (e.g., a hardwood floor or a tile floor), the flat annular support surface 23 tends to have complete surface area engagement with the floor 12 because central cavity 29 removes some of the disk 10 material that might otherwise project below the plane of support surface 23, due, for example, to warpage, manufacturing variances, or disk distortion from heat, age, etc. Annular support surface 23 is a relatively large area surface adapted to seat flat against floor 12 for a good floor-grip action.

The disk upper surface 21 comprises a convex conical surface 31 having a slope angle of about fifteen degrees, and an annular rim surface 33 proximate to the disk circular edge 35. Rim surface 33, is angled to the plane of flat lower surface 23 at an angle of about thirty degrees.

The thirty degree slope angle of rim surface 33 is greater than the fifteen degree slope angle of conical surface 31, such that the perimeter edge area 36 of the disk is somewhat thicker than the disk wall area 37 circumscribed by cylindrical surface 25. The disk perimeter edge area 36, is, therefore relatively inflexible or rigid, compared to the disk wall defined by conical surfaces 31 and 27.

Depending on the durometer of the resilient disk material, the disk wall area designated by numeral 37 in FIG. 1, can have some slight flexibility and resilience for improved gripment of the door lower edge. As shown in FIG. 3, movement of the door in a right-to-left direction will cause the door lower edge to abut conical surface 31, thereby generating a downward force 39 on the disk. Flexibility and resilience of wall 37 will absorb the downward force and contribute to a desired wedge grip of the disk on floor 12 and the lower edge of door 14. Wall 37 can act somewhat like a stiff diaphragm to enhance the grip action on the door lower edge.

The resilience and flexibility of wall 37 is affected to a certain extent by the thickness of wall 37. Typically, the thickness of wall 37 may be about one-eighth inch. Preferably the durometer of the disk material, and the thickness of wall 37 are selected so that wall 37 has relatively slight flexibility and resilience. Certain relatively heavy doors develop considerable momentum force. Therefore, in order to absorb such forces and preserve the integrity of the disk, the resilience and flexibility of the disk are controlled so that the disk has a reasonably stiff but slightly resilient character.

Materials other than rubber can be used to form disk 10. For example, certain rigid, or semi-rigid, plastic materials could be used. Harder materials such as wood and aluminum could also be used, but possibly with some sacrifice in performance. When harder materials are used for the disk material, an annular ring of deformable sheet material (e.g., sheet rubber) can be adhesively secured to annular flat surface 23 to prevent the disk from slipping, or sliding, on hard floors.

Figure 4:
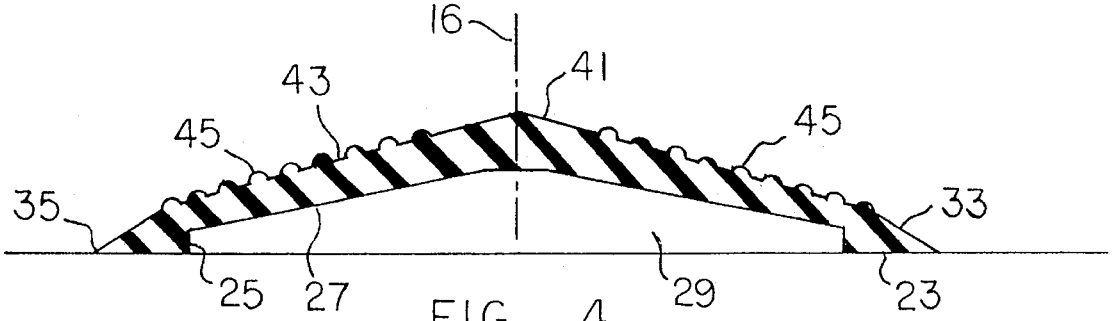
FIG. 4, is a sectional view, taken in the same direction as FIG. 1, but illustrating another embodiment of the invention.

FIG. 4, is a sectional view, taken in the same direction as FIG. 1, but illustrating another embodiment of the present invention.

Figure 5:
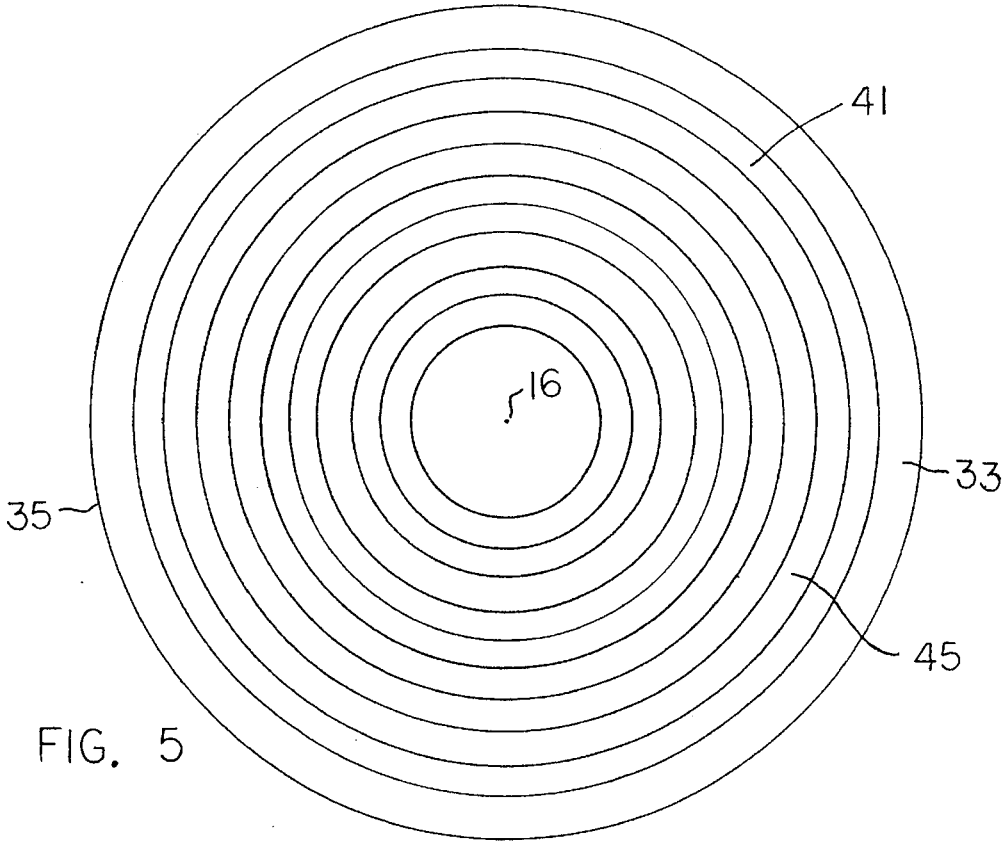
FIG. 5, is a top plan view, of the FIG. 4 doorstop.

FIG. 5, is a top plan view, of the FIG. 4 doorstop.

Figure 6:
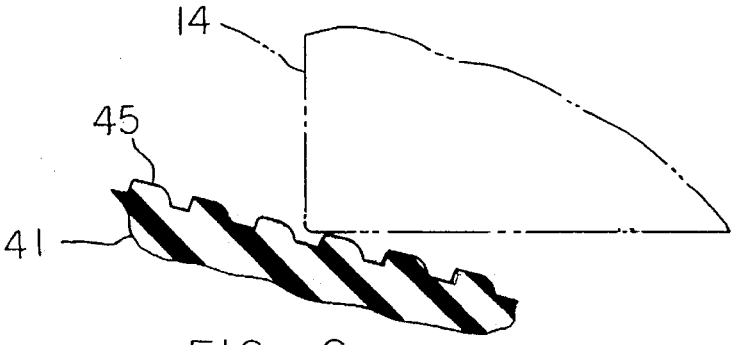
FIG. 6, is an enlarged fragmentary sectional view, illustrating a structural surface configuration used in the FIG. 4, doorstop.

FIG. 6, is an enlarged fragmentary sectional view, illustrating a structural surface configuration used in the FIG. 4 doorstop.

In the doorstop depicted in FIG. 1, the convex conical surface 31, is smooth, continuous and uninterrupted. FIGS. 4 through 6, illustrate a circular disk doorstop 41, of the present invention, wherein the corresponding convex conical surface 43, has a multiplicity of concentric annular ridges 45 extending therealong. Each annular ridge 45 is centered around the central vertical axis 16.

Each annular ridge 45 has a relatively small height dimension, e.g., about 0.05 inch. With a resilient deformable material used for the disk 41, each annular ridge 45, will be individually compressible. The ridges 45 are spaced apart a slight distance, e.g., 0.02 inch, such that each ridge 45 can deform independently of the other ridges 45 when the lower edge of the door 14 comes into contact with the ridged surface. The individual ridges 45 grip the door lower edge to releasably retain the door 14 in its open position.

The doorstop depicted in FIGS. 4 through 6, can be constructed in the same size and configuration as the doorstop of FIG. 1. Each construction achieves a wedge fit between the floor and door lower edge, for releasably retaining the door in its open position.

One advantage of the illustrated doorstop constructions is that the circular disk 10 or 41, cannot be easily overturned or displaced. The circular disk 10 or 41 lies flat on the floor surface so that it cannot be accidently tipped over, e.g., by inadvertent contact with a person's foot.

The circular disk has a relatively large surface area 23, in contact with the floor, such that the disk is resistant to sliding, or slipping, when the disk upper surface is forcibly contacted by the door lower edge. The disk has a "wide stance" support on the floor, with the floor contact points (at circular edge 35) spaced laterally from the door contact point. The "wide stance" support for the disk tends to prevent slippage of the disk.

A further advantage of the illustrated disk structures is that the disk does not have to be specially oriented relative to the motion path of the door. The convex conical surface 27 or 43, faces in all directions, such that the disk can be rotated or positioned in any orientation without affecting the ability of the disk to properly contact the door lower edge.

An additional advantage of the circular disk doorstop is that its symmetry around central axis 16, gives the disk a pleasing ornamental appearance. The disk is unobtrusive, such that the disk tends to blend with any room decor.

The present invention, described above, relates to a Circular Disk Doorstop. Features of the present invention are recited in the appended claims. The drawings contained herein necessarily depict structural features and embodiments of the Circular Disk Doorstop, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A portable doorstop comprising a circular disk formed of a resilient deformable material;

said disk having a lower surface adapted to seat on a floor, and an upper surface adapted to engage the lower edge of a door;

said circular disk having a central vertical axis and a circular edge centered on said axis;

said disk upper surface comprising a convex conical surface centered on said central vertical axis;

said convex conical surface having a slope angle of approximately fifteen (15) degrees for wedge fit interaction with a door lower edge;

said disk lower surface comprising an annular flat, horizontal, support surface (23) proximate to the disk circular edge, a concave conical surface (27) centered on said central axis, and an upstanding concave cylindrical surface (25) joining said flat, horizontal, support surface to said concave conical surface;

said concave conical surface and said upstanding concave cylindrical surface cooperatively forming a vacant cavity within a space circumscribed by said annular flat, horizontal, support surface;

said disk upper surface comprising an annular rim surface (33) proximate to the disk circular edge;

said annular rim surface sloping upwardly from said circular edge at an acute angle to the plane of said flat horizontal support surface substantially greater than fifteen (15) degrees;

said convex conical surface (31) and said concave conical surface (27) being spaced apart by a relatively small distance so as to form an annular deflectable diaphragm;

said convex conical surface having a multiplicity of concentric annular deformable ridges centered around said central vertical axis; and the widths of said ridges being greater than the spacings between the ridges.

2. A portable doorstop comprising a circular disk formed of a resilient deformable material;

said disk having a lower surface adapted to seat on a floor, and an upper surface adapted to engage the lower edge of a door;

said circular disk having a central vertical axis and a circular edge centered on said axis;

said disk upper surface comprising a convex conical surface centered on said central vertical axis;

said convex conical surface having a slope angle of approximately fifteen (15) degrees for wedge fit interaction with a door lower edge;

said disk lower surface comprising an annular flat, horizontal, support surface (23) proximate to the disk circular edge, a concave conical surface (27) centered on said central axis, and an upstanding concave cylindrical surface (25) joining said flat, horizontal, support surface to said concave conical surface; said concave conical surface and said upstanding concave cylindrical surface cooperatively forming a vacant cavity within a space circumscribed by said annular flat, horizontal, support surface;

said disk upper surface comprising an annular rim surface (33) proximate to the disk circular edge;

said annular rim surface sloping upwardly from said circular edge at an acute angle to the plane of said flat horizontal support surface substantially greater than fifteen degrees;

said convex conical surface (31) and said concave conical surface (27) being spaced apart by a relatively small distance so as to form an annular deflectable diaphragm.

* * * * *